US007882965B1

(12) United States Patent
Kao

(10) Patent No.: US 7,882,965 B1
(45) Date of Patent: Feb. 8, 2011

(54) HAND TOOL HOLDER

(76) Inventor: Jui-Chien Kao, No. 358, Tunghsing Rd., Shuwang Li, Tali, Taichung Hsien (TW)

( * ) Notice: Subject to any disclaimer, the term of this patent is extended or adjusted under 35 U.S.C. 154(b) by 0 days.

(21) Appl. No.: 12/628,260

(22) Filed: Dec. 1, 2009

(51) Int. Cl.
*A47F 7/00* (2006.01)

(52) U.S. Cl. ..... 211/70.6; 211/94.01; 211/106.01; 248/303; 248/304

(58) Field of Classification Search ..... 211/94.01, 211/70.6, 106.01; 248/215, 223.4, 225.11, 248/303, 304, 307; 206/349, 372, 373, 376, 206/378
See application file for complete search history.

(56) References Cited

U.S. PATENT DOCUMENTS 2,754,974 A * 7/1956 Larson ..... 211/70.6
2,805,777 A * 9/1957 Larson ..... 211/70.1
RE24,862 E * 8/1960 Odlum et al. ..... 211/70.6
5,513,758 A * 5/1996 Lin ..... 211/70.6
5,582,377 A * 12/1996 Quesada ..... 248/229.12
7,258,239 B2 * 8/2007 Kao ..... 211/70.6
2007/0017886 A1 * 1/2007 Kao ..... 211/94.01

* cited by examiner

*Primary Examiner*—Korie Chan
(74) *Attorney, Agent, or Firm*—Alan Kamrath; Kamrath & Associates PA

(57) ABSTRACT

A hand tool holder has a base and multiple holding elements. The base has a hanging seat and a track. The track protruding from the hanging seat. Each holding element has a sliding block, a protrusion, an extending board, a mounting stub, a shaft mount and a hanging shaft. The sliding block is mounted on the track. The protrusion protrudes from the sliding block. The extending board protrudes from the protrusion. The mounting stub protrudes from the extending board. The shaft mount protrudes from the protrusion, is opposite to the mounting stub and has an inserted block located on a bottom of the shaft mount. The hanging shaft is metal, is wrapped in the inserted block by injection molding.

6 Claims, 5 Drawing Sheets

HAND TOOL HOLDER

BACKGROUND OF THE INVENTION

1. Field of the Invention

The present invention relates to a holder, and more particularly to a hand tool holder.

2. Description of Related Art

A hand tool holder can be mounted on a wall with fasteners and has multiple hanging hooks on which multiple wrenches are hanged.

However, a conventional hand tool cannot hold a sleeve. Furthermore, in order to hang a heavily hand tool on the conventional hand tool holder, sizes of the hanging hooks have to be increasing according to weights of the wrenches so causing waste of material.

To overcome the shortcomings, the present invention tends to provide a hand tool holder to mitigate or obviate the aforementioned problems.

SUMMARY OF THE INVENTION

A hand tool holder has a base and multiple holding elements. The base has a hanging seat and a track. The track protruding from the hanging seat. Each holding element has a sliding block, a protrusion, an extending board, a mounting stub, a shaft mount and a hanging shaft. The sliding block is mounted on the track. The protrusion protrudes from the sliding block. The extending board protrudes from the protrusion. The mounting stub protrudes from the extending board. The shaft mount protrudes from the protrusion, is opposite to the mounting stub and has an inserted block located on a bottom of the shaft mount. The hanging shaft is metal, is wrapped in the inserted block by injection molding. Therefore, the holding elements is durable in structure to load and support a heavily hand tool.

Other objects, advantages and novel features of the invention will become more apparent from the following detailed description when taken in conjunction with the accompanying drawings.

DETAILED DESCRIPTION OF PREFERRED EMBODIMENT

Figure 1:
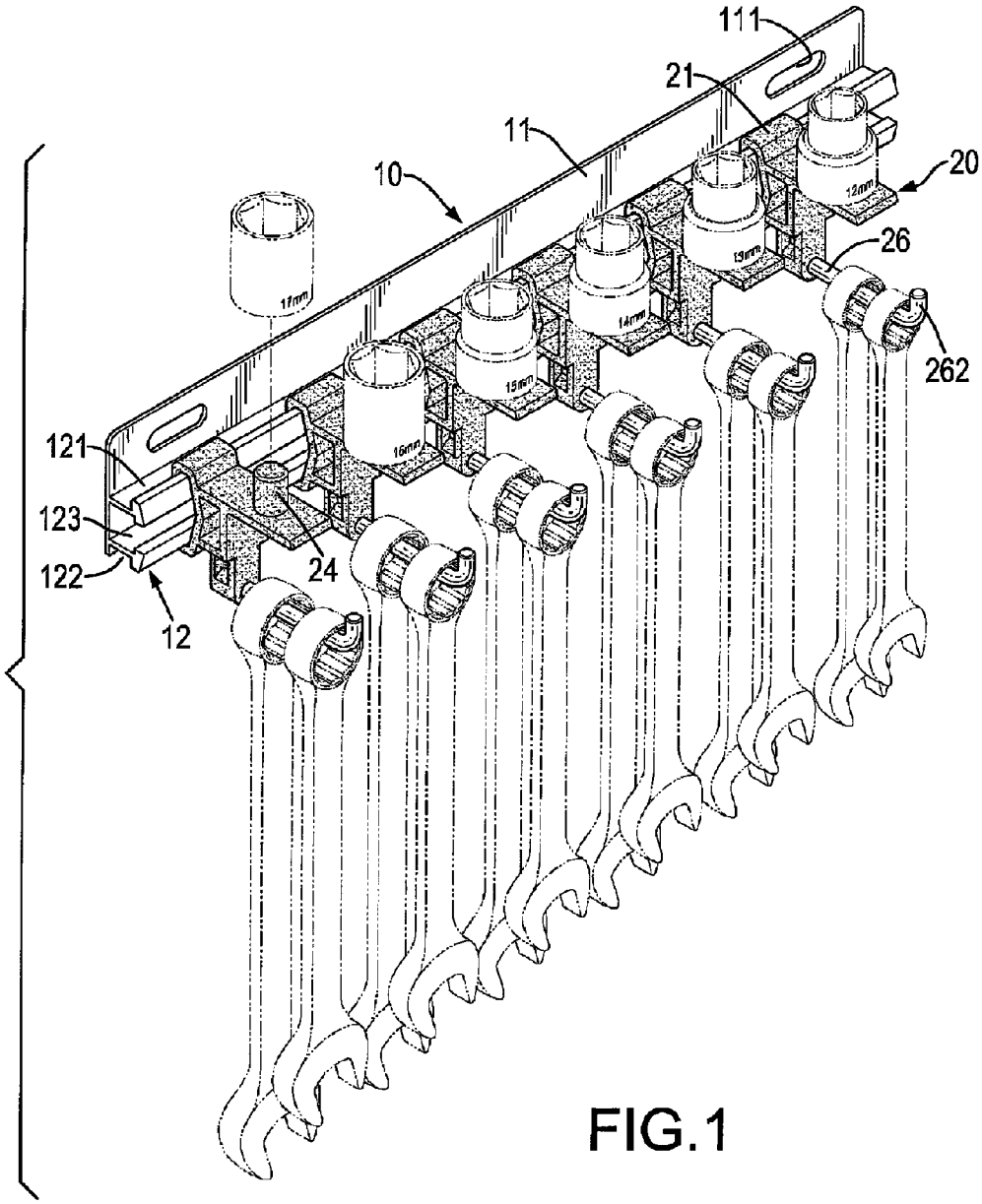
FIG. 1 is a partially exploded perspective view of a hand tool holder in accordance with the present invention with tools.
Figure 2:
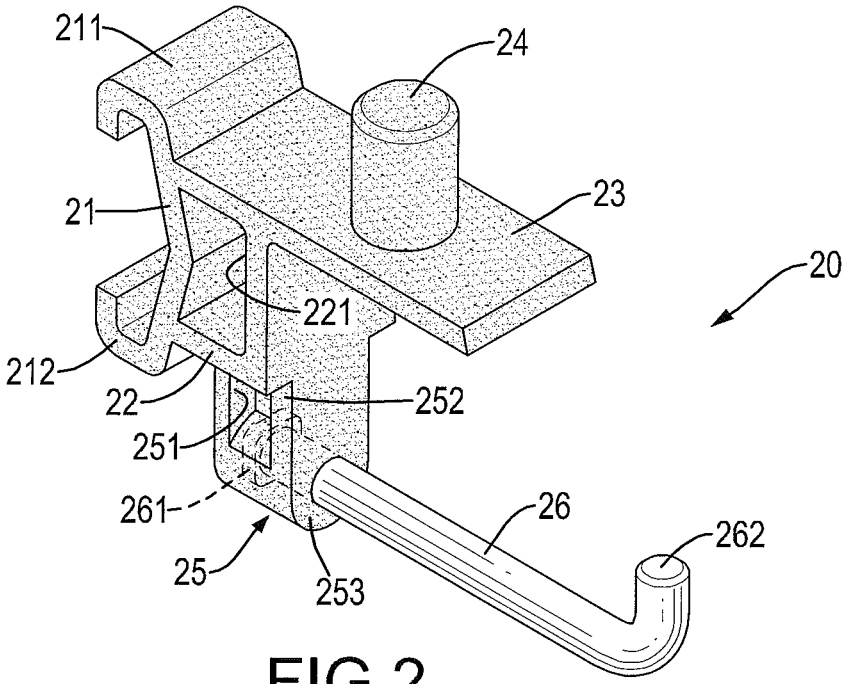
FIG. 2 is an enlarged perspective view of a holding element of the hand tool holder in FIG. 1.
Figure 3:
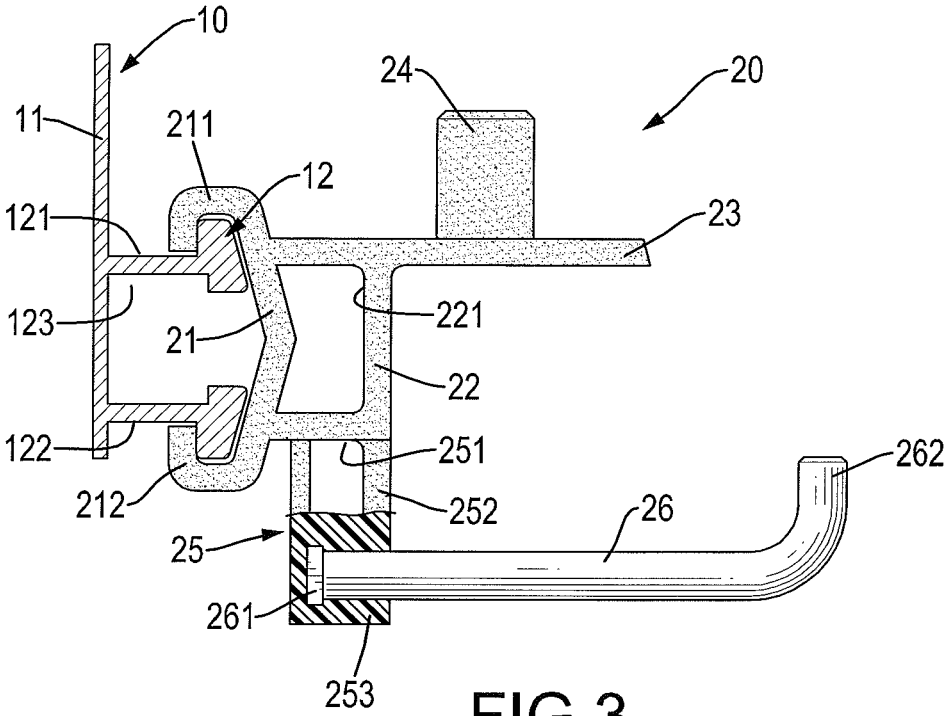
FIG. 3 is an enlarged side view in partial section of the hand tool holder in FIG. 1.

With reference to FIGS. 1 to 3, a hand tool holder in accordance with the present invention comprises a base (10) and multiple holding elements (20). The base (10) has a hanging seat (11) and a track (12). The hanging seat (11) is rectangular and has two hanging holes (111). The two hanging holes (111) are defined through the hanging seat (11) and the hand tool holder may be mounted on a wall with two fasteners mounted through the hanging holes (111). The track (12) protrudes from along the hanging seat (11) and has a top surface, a bottom surface, an abutting surface, a top channel (121), a bottom channel (122) and a ditch (123). The abutting surface is perpendicularly the top surface and the bottom surface. The top channel (121) is defined in along the top surface of the track (12). The bottom channel (122) is defined in along the bottom surface of the track (12). The ditch (123) is defined in along the abutting surface of the track (12) between the top surface and the bottom surface to provide a space, so that the top surface of the track (12) and the bottom surface of the track (12) is allowed to be curved.

The holding elements (20) are manufactured by injection molding and each holding element (20) has a sliding block (21), a protrusion (22), an extending board (23), a mounting stub (24), a shaft mount (25) and a hanging shaft (26). The sliding block (21) is slidably mounted on the track (12) and has a top arm (211) and a bottom arm (212). The top arm (211) slidably hooks in the top channel (121). The bottom arm (212) slidably hooks in the bottom channel (122). The protrusion (22) protrudes from the sliding block (21), is hollow and opposite to the track (12) and has an extending surface and a through hole (221). The through hole (221) is defined through the protrusion (22). The extending board (23) is a rectangular board and is formed on and protrudes from the protrusion (22). The mounting stub (24) is a cylinder and perpendicularly protrudes from the extending board (23). The shaft mount (25) perpendicularly protrudes from the extending surface of the protrusion (22) and is opposite to the mounting stub (24). The extending stub (25) has two sides, a bottom, two recesses (251), four ribs (252) and an inserted block (253). The recesses (251) are respectively defined in the two sides of the shaft mount (25) to form the four ribs (252) respectively at the sides of the shaft mount (25). The inserted block (253) has a round cross section and is formed on the bottom of the shaft mount (25) below the four ribs (252) and the recesses (251). The hanging shaft (26) is metal, is wrapped in the inserted block (253) by injection molding and has an inserted end, a hanging end, a flange (261) and a hook (262). The inserted end of the hanging shaft (26) is inserted the inserted block (253). The hanging end of the hanging shaft (26) is opposite to the inserted end of the hanging shaft (26), protrudes from the inserted block (253) and having an extension length from the inserted block (253) longer that of the extending board (23) from the protrusion (22). The flange (261) is square in cross section, protrusions from the inserted end of the hanging shaft (26) and is wrapped in the inserted block (253), so the hanging shaft (26) is engaged the inserted block (253) by the flange (261). The hook (262) protrudes upwardly from the hanging end.

Figure 4:
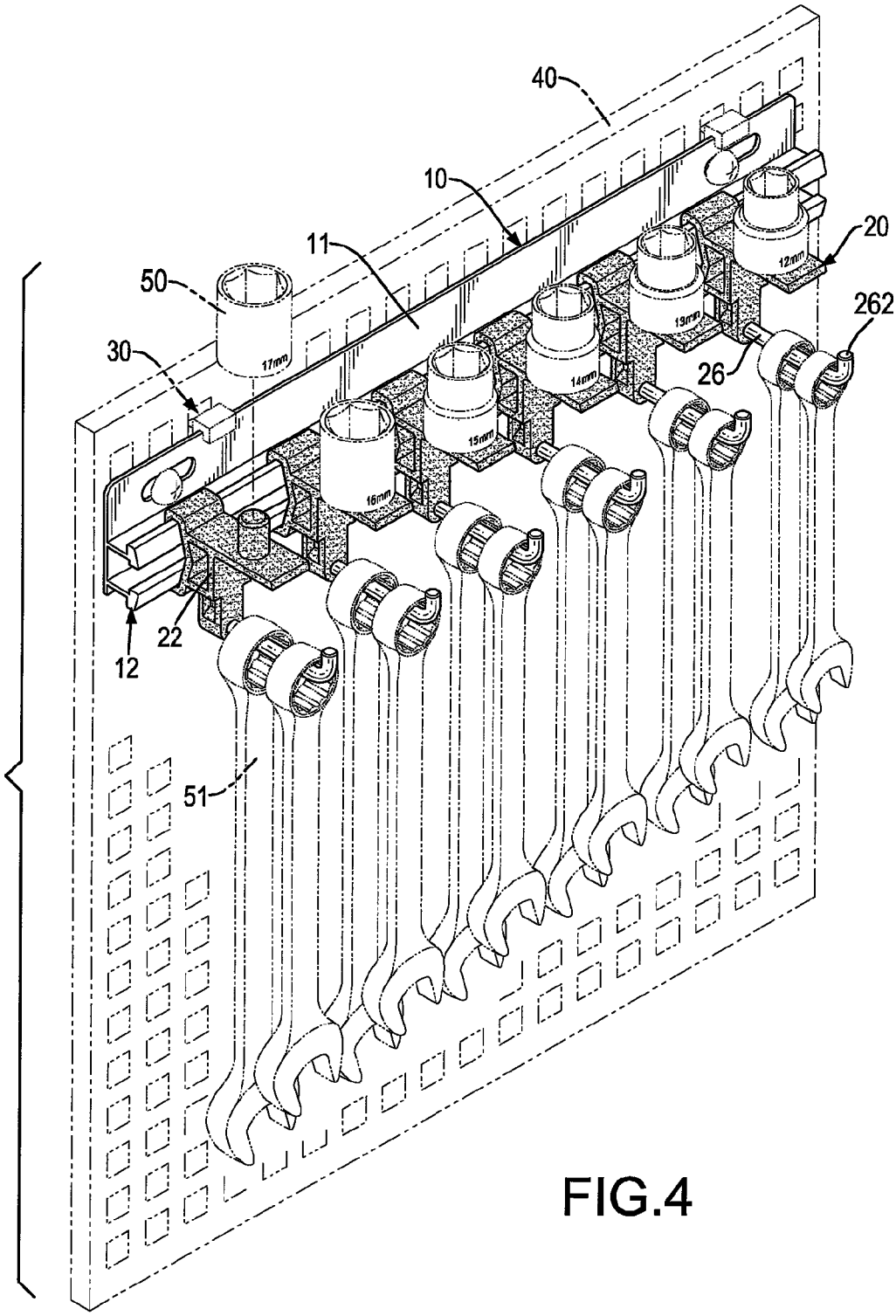
FIG. 4 is an operational and partially exploded perspective view of the hand tool holder in FIG. 1 with tools being mounted on a ped board.
Figure 5:
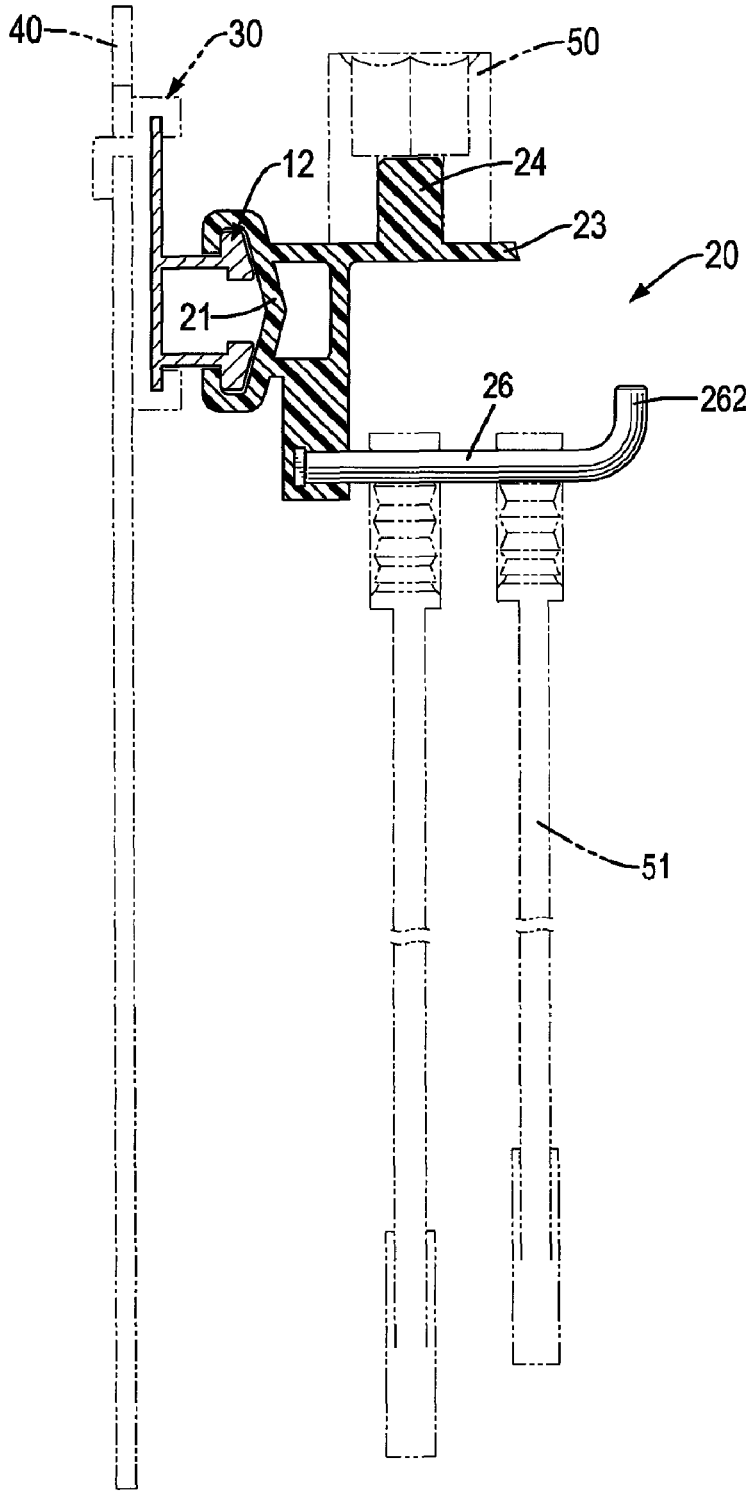
FIG. 5 is an operational enlarge side view in partial section of the hand tool holder in FIG. 1.
Figure 6:
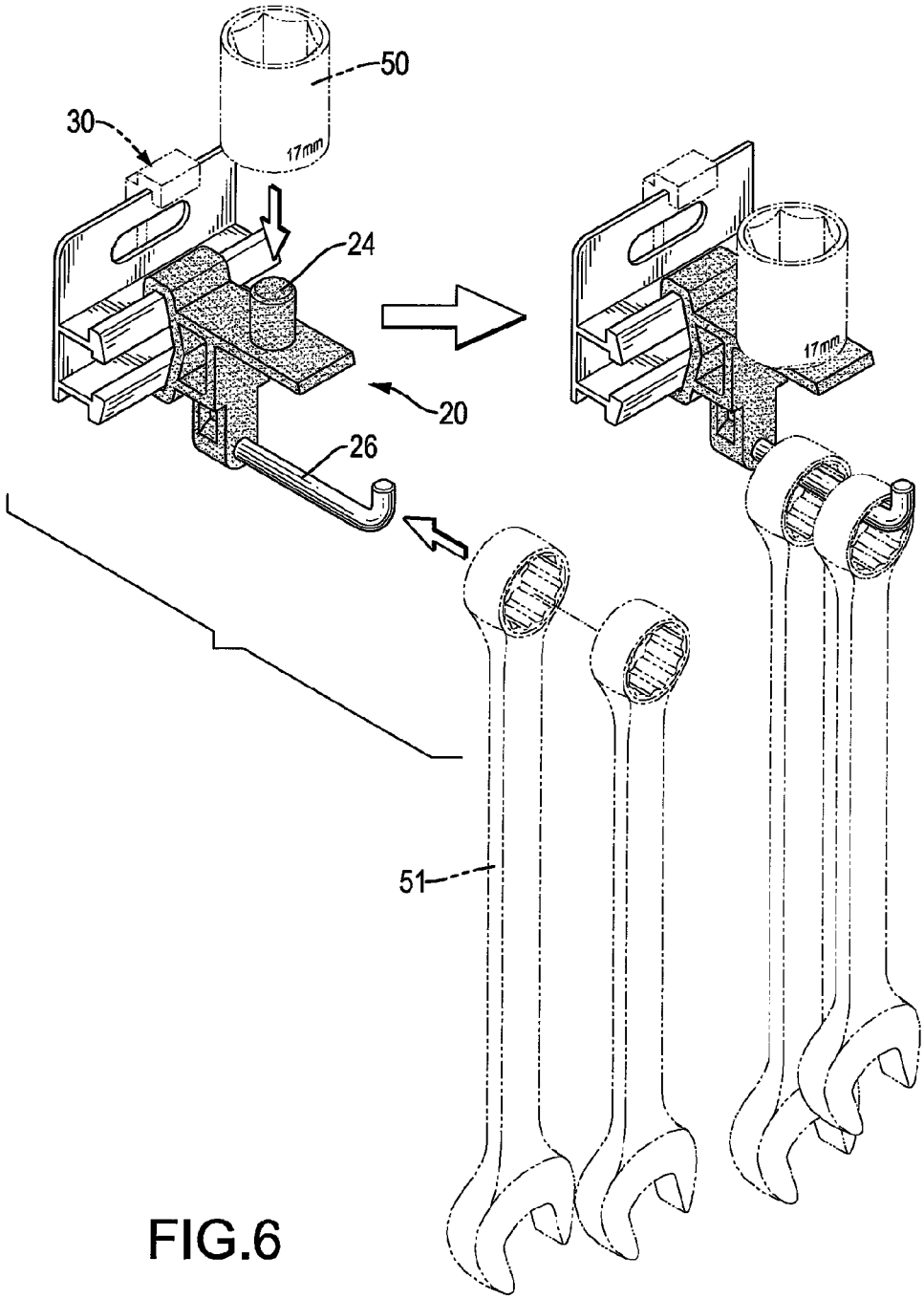
FIG. 6 is an exploded operational perspective view of the hand tool holder in FIG. 1.

With reference to FIGS. 4 to 6, the hand tool holder may be mounted on a peg board (40) with two locking elements (30). Wrenches (51) are respectively hanged on the hanging shafts (26) and sleeves (50) are respectively mounted on the mounting stubs (24). Because the hanging shaft (26) is metal and is wrapped in the inserted block (253) by injection molding, structural strength of the hanging shaft (26) is increased. Furthermore, the four ribs (252) make the shaft mount (25) having an "H" cross-section, such that the structural strength of the shaft mount (25) is improved to avoid the shaft mount (25) from being deformed or bent. Therefore, the holding elements (20) is durable in structure to load and support a heavily hand tool.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hand tool holder comprising:

a base having a hanging seat;

a track protruding from the hanging seat and having a top surface;

a bottom surface;

a top channel defined in the top surface of the track;

a bottom channel defined in the bottom surface of the track; and multiple holding elements and each having a sliding block slidably mounted on the track and having a top arm slidably hooked on the top channel;

a bottom arm slidably hooked on the bottom channel;

a protrusion protruding from the sliding block, being opposite to the track and having an extending surface;

an extending board protruding from the protrusion;

a mounting stub protruding from the extending board;

a shaft mount perpendicularly protruding from the extending surface of the protrusion, being opposite to the mounting stub and having a bottom;

two sides;

four ribs;

two recesses respectively defined in the two sides of the shaft mount to form the four ribs respectively at the sides of the shaft mount;

an inserted block having a round cross section, formed on the bottom of the shaft mount below the four ribs and the recesses; and a hanging shaft being metal, wrapped in the inserted block by injection molding and having an inserted end wrapped in the inserted block;

a hanging end opposite to the inserted end of the hanging shaft and protruding from the inserted block;

a flange protruding from the inserted end of the hanging shaft and wrapped in the inserted block; and a hook protruded upwardly from the hanging end.

2. The hand tool holder as claimed in claim 1, wherein each protrusion has a through hole defined through the protrusion.

3. The hand tool holder as claimed in claim 1, wherein each extending board is a rectangular board; and the hanging end of each hanging shaft having an extension length from a corresponding inserted block longer that of a corresponding extending board from a corresponding protrusion.

4. The hand tool holder as claimed in claim 2, wherein each extending board is a rectangular board; and the hanging end of each hanging shaft having an extension length from a corresponding inserted block longer that of a corresponding extending board from a corresponding protrusion.

5. The hand tool holder as claimed in claim 3, wherein the hanging seat is rectangular and has two hanging holes defined through the hanging seat.

6. The hand tool holder as claimed in claim 4, wherein the hanging seat is rectangular and has two hanging holes defined through the hanging seat.

* * * * *